United States Patent [19]

Greiner et al.

[11] Patent Number: 4,665,824

[45] Date of Patent: May 19, 1987

[54] STORAGE AND RETRIEVAL OF PRINTING PROCESS DATA ENCODED ON A PRINTING PLATE

[75] Inventors: Harry M. Greiner, Offenbach am Main; Hermann Fischer, Augsburg; Claus Simeth, Offenbach am Main, all of Fed. Rep. of Germany

[73] Assignee: M.A.N.-Roland Druckmaschinen Aktiengesellschaft, Fed. Rep. of Germany

[21] Appl. No.: 843,880

[22] Filed: Mar. 26, 1986

Related U.S. Application Data

[63] Continuation of Ser. No. 667,866, Nov. 2, 1984, abandoned.

[30] Foreign Application Priority Data

Nov. 2, 1983 [DE] Fed. Rep. of Germany ..... 3339552

[51] Int. Cl.[4] ..... B41F 33/16

[52] U.S. Cl. ..... 101/426; 101/DIG. 25

[58] Field of Search ..... 101/132, 136, 137, 138–145, 101/1, 368, 132.5, 375, 395, DIG. 25, 365, DIG. 26

[56] References Cited

U.S. PATENT DOCUMENTS

| | | | |
|---|---|---|---|
| 3,650,204 | 3/1972 | Burger et al. | 101/45 |
| 3,671,722 | 6/1972 | Christie | 235/61.12 N |
| 3,898,928 | 8/1975 | Kaneko | 101/132.5 |
| 3,958,509 | 5/1976 | Murray et al. | 101/426 |
| 4,082,039 | 4/1978 | Schutt | 101/132.5 |
| 4,200,932 | 4/1980 | Schramm et al. | 364/519 |
| 4,233,663 | 11/1980 | Sugawara et al. | 364/515 |
| 4,437,403 | 3/1984 | Greiner | 101/248 |
| 4,586,148 | 4/1986 | Rehder et al. | 101/DIG. 25 |

FOREIGN PATENT DOCUMENTS 995891 6/1965 United Kingdom .

*Primary Examiner*—J. Reed Fisher

*Attorney, Agent, or Firm*—Leydig, Voit & Mayer

[57] ABSTRACT

A job strip encoding printing process data is disposed on an indicia-free zone of an associated printing plate. The printing process data include process control data, press presetting data and organization data for the entire print order using the associated printing plate. Preferably, all of the important printing adjustments are computer controlled and the printing machine includes a scanner for automatically reading the job strip when the printing plate is clamped onto the plate cylinder of the printing machine. The job strip is not integral with the printing plate so that the printing process data are easily changed. The job strip, however, is attached to the printing plate and therefore the printing process data and associated printing plates are not mixed up in the print shop. The job strip is elongated and aligned parallel and adjacent to a longitudinal edge portion of the printing plate which is clamped to the plate cylinder. The job strip is circumferentially displaced from but located close to the area of the printing plate which is capable of printing and which engages the blanket cylinder, so that the inking rollers roll over the job strip during printing to keep it clean for scanning.

6 Claims, 15 Drawing Figures

STORAGE AND RETRIEVAL OF PRINTING PROCESS DATA ENCODED ON A PRINTING PLATE

This application is a continuation of application Ser. No. 667,866, filed Nov. 2, 1984, now abandoned.

BACKGROUND OF THE INVENTION

1. Field of the Invention

The invention relates to computerized controls for printing machines and methods for setting up printing operations.

2. Background Art

Data for controlling the printing process are supplied to the press from a very wide variety of sources. The processing and updating of these data call for considerable labor on the part of the press operator and any supporting staff. Also, the associated data job procedure and the overhead involved call for optimal execution at the printing press. It is only at the press that the data necessary for dealing with a client's job converge and where in the event of delay the major financial loss occurs. The printing press has the highest hourly rate in the chain involved in dealing with a job.

A conventional control and method scans the proof sheet or a printed sheet for measurement in order to derive presetting values for the zonal ink metering elements. Preferably, such a system uses a central microcomputer along with additional microcomputers for scanning of the sheet and adjusting the zonal ink metering elements, as is described in Schramm et al., U.S. Pat. No. 4,200,932 issued April 29, 1980.

Sensing using film originals is unsatisfactory because it is too inaccurate.

Measuring methods are also known which, with the use of one or more sensors, measure a plate lying flat on a table or a plate made ready on a cylinder, in both cases outside the press. See, for example, Sugawara et al. U.S. Pat. No. 4,233,663 issued Nov. 11, 1980, and Murray et al. U.S. Pat. No. 3,958,509 issued May 25, 1976. The measured surface coverage values are transmitted between data stores or memories and, in a further working step, the values are conveyed to adjusting devices for the zonal ink metering elements.

All these methods are relatively complicated and lack data for job control resulting in a relatively unreliable overall system. The resulting accuracy of preadjustment is therefore not very high.

French Patent No. 1,519,883 published Apr. 14, 1968 discloses a plate cylinder for a rotary offset press, the cylinder having provision for zonewise scanning of plate inking, inking being sensed in the various ink zones by means of a densitometric measuring device over the whole periphery of the plate cylinder as the cylinder rotates.

Greiner U.S. Pat. No. 4,437,403 issued Mar. 20, 1984, discloses an automatic control method and apparatus for adjusting the register of printing plates by scanning register marks on the plates when the plates are mounted on their respective plate cylinders.

West German Patent No. 2,922,964 published Dec. 20, 1979 discloses a system for making ready and controlling a printing press; the presetting or preadjustment concerns mainly the inking unit, moisture conveyance and the damping and folding unit. The aim is said to be to provide a system enabling these mechanical parts of a press to be preadjusted and further adjusted automatically. To this end, the invention provides inter alia means for predetermining the necessary mechanical adjustments in dependence upon input data. Parameters such as the printing press, the printed product, the printing zone and the job procedure can be introduced for preadjustment.

SUMMARY OF THE INVENTION

Accordingly, the primary object of the present invention to provide a method and apparatus for reducing press down time caused by unorganized printing process data. A specific object of the invention is to provide a means for storing printing process data for a specific printing plate in a way that the data are readily available and are not confused with data for a different printing plate.

Briefly, in accordance with the present invention, the printing plate in a printing machine has an "indicia-free zone" including at least one "job strip" encoding printing process data. The "indicia-free zone" is located in a nonprinting area of the printing plate adjacent to one of the longitudinal edge portions of the printing plate which are clamped on a plate cylinder during printing. Although the zone does not include the printing area for the printed matter of the final product, the indicia free zone is precisely located next to the area of the printing plate capable of printing so that the inking and dampening rollers roll over the indicia-free zone. The printing process data is encoded on the job strip during or after preparation of the printing plate, and the job strip can be read inside or outside the press by means of scanners.

Since inking and dampening rollers roll over the job strip, the job strip always remains accessible for scanning. Also, light dust particles which may accumulate when the press is running are eliminated by the inking and dampening rollers. In this fashion, the job strip is kept clean for the scanning. To further ensure reliable reading of the job strip, the data are encoded according to a selfclocking binary format which does not require precise registration of the scanner with the job strip or a fixed scanning speed.

The printing process data stored on the job strip preferably include organization data, presetting or adjustment data, and data for supervising the printing process. Since all of these data are stored on the job strip on the printing plate, the printer no longer needs to act as an organizer and combine the wide variety of data from different sources in order to carry out a printing job on the printing machine. In other words, frequent queries, down-time and misunderstandings in the print shop are obviated since all of the data required to organize and preset the press and supervise the process are combined and stored in the same place along with the respective printing plate. Moreover, the presetting or adjustment data can be automatically read when the printing plate is clamped onto the plate support in the printing machine, so that no further operator intervention is required to preset or adjust the machine.

BRIEF DESCRIPTION OF THE DRAWINGS

Other objects and advantages of the present invention will become apparent upon reading the following detailed description and upon reference to the drawings in which.

DETAILED DESCRIPTION OF THE PREFERRED EMBODIMENTS

Figures 1, 2:
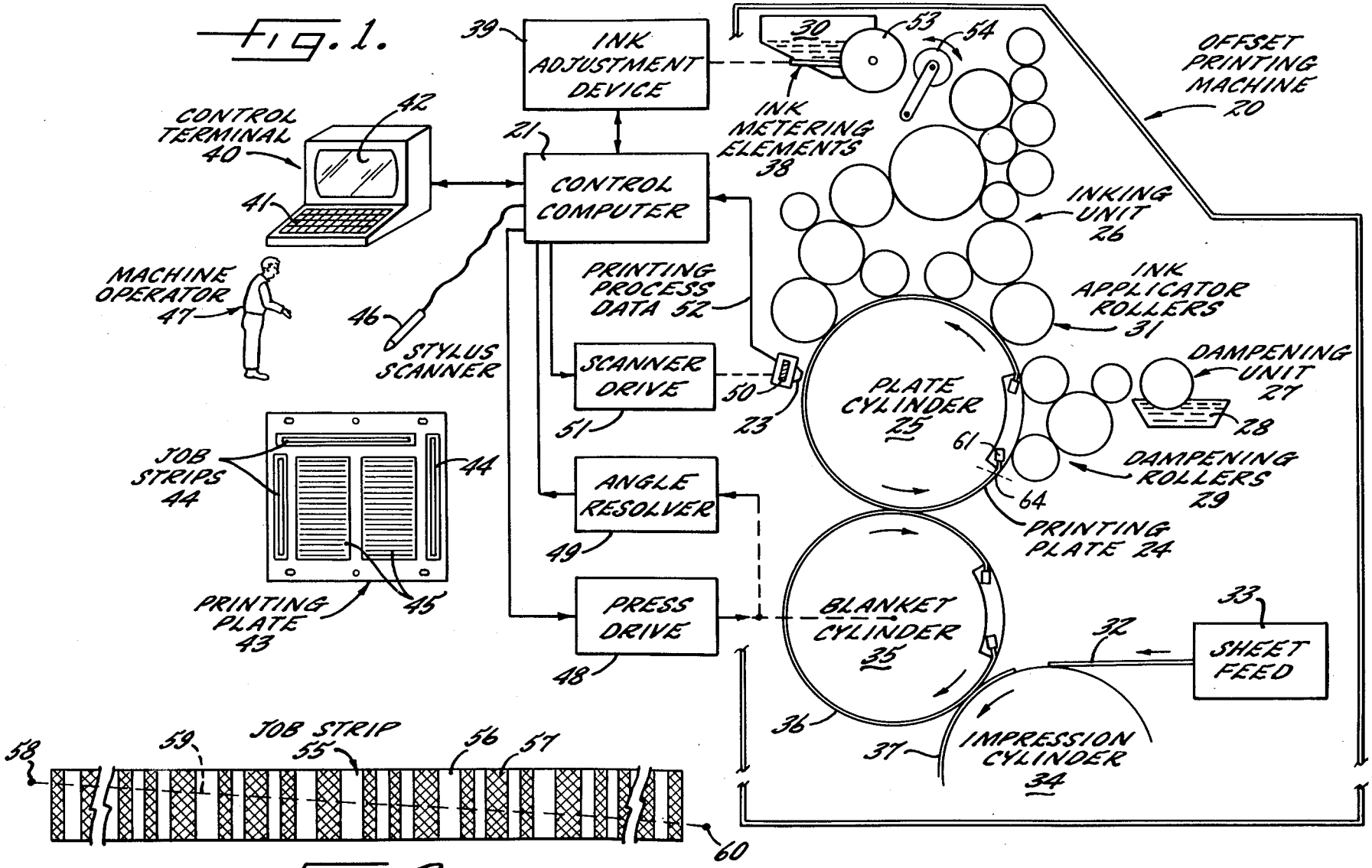
FIG. 1 is a schematic diagram of an offset printing machine using a computer control system employing the present invention.
FIG. 2 is a pictorial diagram of a job strip encoding printing process data.

Turning now to FIG. 1, there is shown an offset printing machine generally designated 20 controlled by a computer 21 and employing a scanner 23 capable of reading job strips on a printing plate 24 when the printing plate is clamped to an associated plate cylinder 25.

As is conventional, the offset printing machine 20 has an inking unit 26 for applying ink to the plate cylinder 25 after the plate cylinder is dampened by a dampening unit 27. The dampening unit 27 has a resevoir 28 of a water based dampening medium and the dampening medium is conveyed by dampening rollers 29 to the printing plate 24. After the printing plate 24 is dampened, the inking unit 26 applies ink from an ink resevoir 30 to the printing plate via ink applicator rollers 31.

As is conventional in the offset printing machine 20, the printing plate 24 does not directly contact the sheets to be printed. Rather, the sheets such as the sheet 32 are conveyed by a sheet feed 33 to an impression cylinder 34 which cooperates with a blanket cylinder 35. Ink applied to the printing areas of the printing plate 24 is picked up via a rubber blanket 36 on the blanket cylinder 35 and later transferred from the blanket 36 to the sheet 37 being printed.

As is conventional, the offset printing machine 20 has a plurality of zonal ink metering elements 38 for regulating the transfer of ink from the supply 30 to a plurality of respective printing zones axially spaced across the plate cylinder 25. The ink metering elements 38 have respective servo motors or other ink adjustment device 39 so that the ink metering elements 38 are automatically adjustable by the control computer 21 in response to adjustment values. In particular, when the offset printing machine 20 is first set up for a particular job, the control computer 21 receives presetting or preadjustment values for initially setting the ink metering elements 38. These presetting values, for example, can be received from a control terminal 40 including a manual keyboard 41 and a standard cathode ray tube display 42. Alternatively, the presetting values are obtained from nonvolatile memory or are received on a magnetic tape or disk.

In accordance with an important aspect of the present invention, the printing plate 24 has an "indicia-free zone" including at least one "job strip" encoding printing process data for the respective printing plate. The indicia-free zone does not include indicia for the printed matter of the final product, but the ink applicator rollers 31 and dampening rollers 29 roll over the indicia-free zone.

In addition to the printing plate 24 shown mounted to the plate cylinder 25, there is shown a printing plate 43 before it is clamped on the plate cylinder 25. Three job strips 44 are included on the printing plate 43 and they are placed above and to the sides of columns of printing areas 45 which give rise to the desired printed manner in the final product. The job strips 44 on the printing plate 43 can be read by a stylus scanner 46 manually operated by the machine operator or printer 47 before the printing plate 43 is inserted in the printing machine 20. However, when the printing plate 43 is clamped onto the plate cylinder 25, then the printing plate, such as the printing plate 24 can be read by the scanner 23.

The control computer 21 is programmed to operate the press drive 48 of the printing machine 20 until an angle resolver 49 indicates that one of the job strips 44 is aligned with the scanner 23. The press drive 48, in other words, provides alignment or scanning in the circumferential direction with respect to the plate cylinder 25. To provide scanning in the axially direction with respect to the plate cylinder 25, the scanner 23 is mounted on a cross bar or rail 50 and the scanner 23 is driven in the axially direction by a scanner drive 51 under the control of the computer 21. Preferably, whenever a new printing plate 24 is clamped on the plate cylinder 25 and a new printing operation is started, the control computer 21 operates the press drive 48 and the scanner drive 51 so that the scanner 23 reads a job strip 44 on the printing plate to obtain printing process data 52 including presetting or preadjustment values for the ink adjustment devices 39.

Even though the offset printing machine 20 has a scanner 23 for automatic scanning when the printing plate 24 is clamped to the plate cylinder 25, it is desirable for the machine operator 47 to first scan the printing plate 43 before it is clamped to the plate cylinder 25 so that organization data is obtained. The organization data, for example, may tell the control computer 21 where the job strips 44 are located on the printing plate 43 so that the control computer can operate the press drive 48 and scanner drive 51 to automatically scan these job strips. The organization data also includes, for example, the client's name, the client's account number, account's department, type of paper, order number, print run, ink type, special ink, and type of printing plate.

In addition to presetting values for the ink adjustment devices 39, the press presetting data may also include values for the print feed or the sheet feed 33, the format adjustment of the sheet feed 33, adjustment of side lays, front lays, bands or tapes, blowing air, grippers, a sheet break, a blowing break, side joggers, pile lowering, palitizing facilities, sheet-counting facilities, sprayers, dryers, paper-clamping facilities, spreader motion, speed of a duct roller 53, the size of the ink strip produced by a vibrator 54 and the cycle rate for the vibrator 54, settings for the dampening unit 27, and the composition of the dampening agent 28.

The printing process data encoded on the job strips 44 may also include data for supervising the printing process, such as ink and dampening-agent feeding, and maximum number of prints to be made with the printing plate 43.

Turning now to FIG. 2 there is shown a pictorial view of a job strip 55 read by optical means. The job strip includes alternate bands or bars of light and dark regions 56, 57 respectively. The job strip encodes the data according to a standard self-clocking binary format. One suitable self-clocking binary format is the well-known Uniform Product Code which is now commonly used for tagging supermarket items. The job strip 55, however, is encoded according to a standard Manchester Code commonly used for magnetic recording of binary computer data. In any event, the code is such that a definite address is associated with each binary bit or instruction encoded on the job strip. In addition, the job strip 55 is encoded as further described below so that the direction in which the job strip is read into the control computer 21 is immaterial. Also, the job strip 55 can be integral with the printing plate or it can be a strip of material bonded or otherwise attached to the printing plate. The dark areas 57 of the job strip 55, for example, can be printing areas of the printing plate. In such a case, the printing areas 57 become darkened with respect to the nonprinting areas 56 when the ink applicator rollers 31 apply ink to the printing plate 24. Alternatively, the job strips 44 can be printed strips or magnetic strips or cards. Consequently, instructions and control procedures can be introduced into the printing plate even after the plate has been etched or engraved.

To scan the job strip 55, it is merely necessary for the scanner 23, 46 to scan a path along the strip, for example, along the dashed line starting in FIG. 2 from an initial point 58 along a path 59 to a final point 60. This path 59 need not be precisely aligned with the job strip 55 and during decoding it is not necessary for the control computer 21 to know the precise position of the scanner 23, 46 along the path. Consequently, a simple and low-cost construction can be used for the scanner drive 51 and the job strip 55 is also easily scanned by the manually operated stylus scanner 46.

Figure 3:
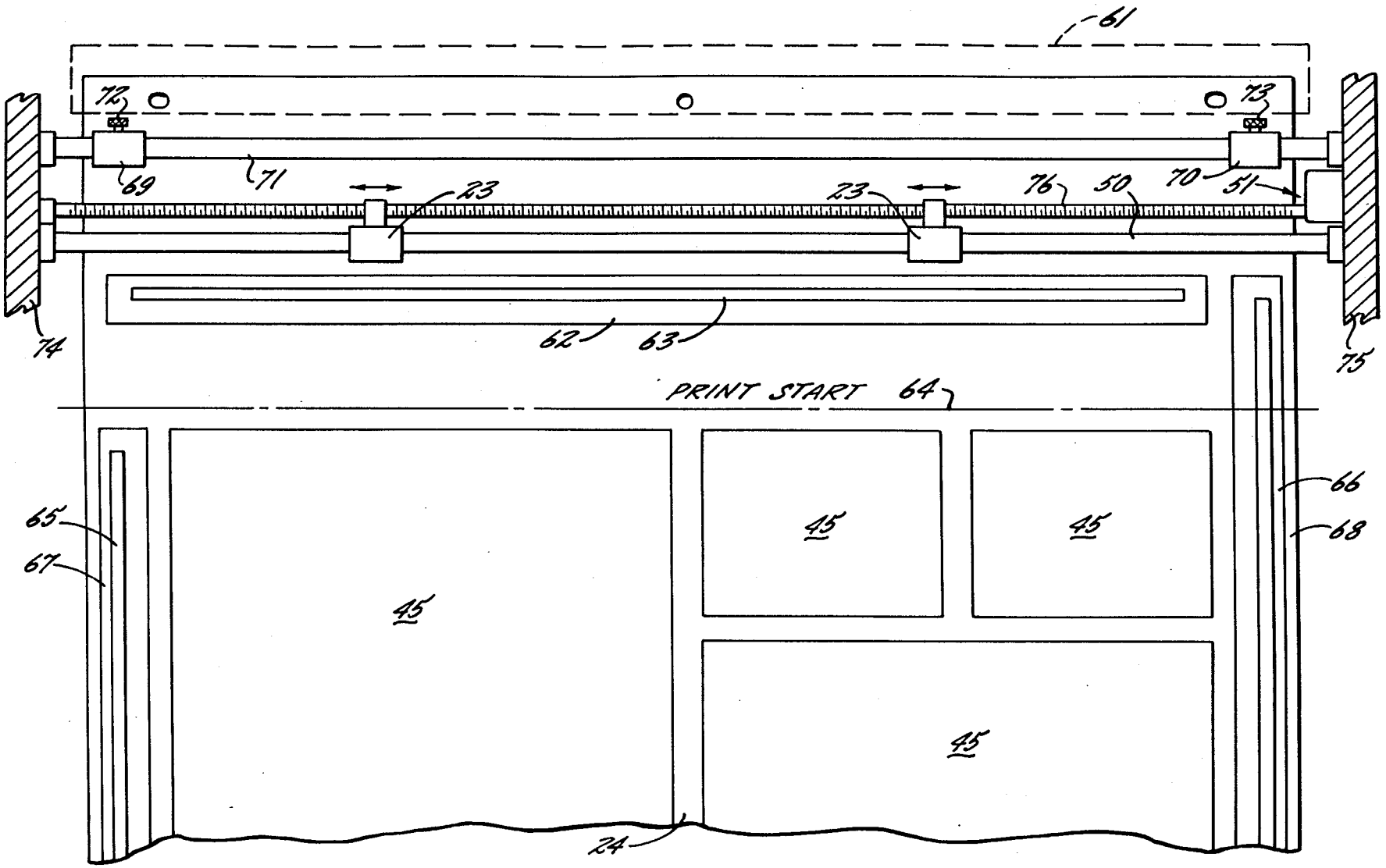
FIG. 3 is a schematic diagram of a number of scanners for scanning a printing plate clamped to the plate cylinder in the offset printing machine of FIG. 1.

Turning now to FIG. 3, there is shown a detailed view of a printing plate 24 clamped on the plate cylinder 25 of FIG. 1 via a clamp 61 shown in dashed representation. The clam 61 extends in the longitudinal direction across the printing plate. Starting from the clamp 61, the plate 24 has an initial portion rolled over partially, if at all, by the ink applicator rollers 31 and dampening rollers 29 shown in FIG. 1. The initial portion is followed as far as the start of printing by a zone over which the ink applicator rollers 31 and dampening rollers 29 roll and in which in accordance with the invention, an elongated indicia-free zone 62 is set aside for receiving a job strip 63. Preferably the job strip 63 is about 2–5 mm after the format start i.e., the start of the area capable of printing which extends further in the circumferential direction. However, the job strip 63 can be copied after the end of the run, in which event it starts some 2–5 mm after the processing edge; otherwise the dirt rising from the sheet rear edge tends to soil the job strip 63. In any event, the job strip 63 should be placed in a clean area of the printing plate during printing.

In FIG. 3 a center line 64 is shown denoting the boundary for the free space on the plate 24 which has not previously been used for the printing process. (As indicated in FIG. 1, engagement between the plate cylinder 25 and the blanket cylinder 35 for printing occurs at this boundary 64; however, the ink and dampening applicator rollers 31, 29 contact the printing plate at a circumferential position in advance of this boundary.) The strip 63 is disposed above this boundary 64 and extends traversely over approximately the whole region of the plate 24. The strip 63 can be, for example, a magnetized zone of the plate 24, which can be read by magnetic heads in the scanners 23. Alternatively, the job strip 63 is an optical strip as shown in FIG. 2 and the scanners 23 include contrast sensors or densitometers. When the strip 63 is not integral with the printing plate 24, the strip is adhesively bonded or otherwise attached to the printing plate in registration with the elongated indicia-free zone 62.

Depending on the amount of printing process data to be stored on the printing plate 24, a number of job strips can be used. It is advantageous, for example, to place additional job strips 65, 66 on respective indicia-free zones 67, 68 in the lateral end zones of the plate 24. These end zone job strips 65, 66 are read out by means of respective stationary scanners or line readers 69, 70. The stationary scanners 69, 70 are also mounted on a traversing rail and can be manually adjusted along the rail 71 and locked into place via respective locking screws 72, 73. The traversing rails 50 and 71 are mounted to the side frames 74, 75 of the printing machine 20 shown in FIG. 1. As shown in FIG. 3, the scanner drive 51 uses a motor driving a lead screw 76.

It should be noted that all of the job strips 63, 65, 66 shown in FIG. 3 can be read by their respective scanners 23, 69, 70 when printing is not occurring. In this case, the control computer 31 operates the press drive 48 and the scanner drive 51 so that the scanners traverse their respective job strips. Moreover, when the press is running, the job strips 65 and 66 which are in the end zones of the plate 24 can be read by their respective scanners 69, 70 when the press is running, since these strips become disposed circumferentially with respect to the plate cylinder when the printing plate is clamped.

It should be noted that the job strips 63, 65, 66 produce no image on the end product. The plate 24 is therefore used in a dead zone of the free space not previously taken up by the printing. Since there is no risk of different print orders being mixed up in the print shop, the information content of the job strips can be used multifunctionally to control organization procedures and press presettings in the printing process for the particular printing plate 24.

Figure 4:
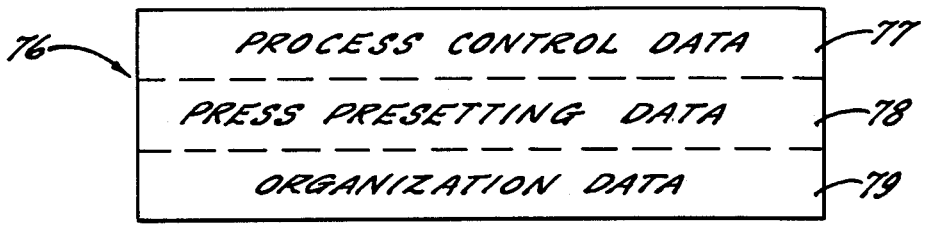
FIG. 4 is a diagram showing the components of the printing process data encoded in the job strip.

As previously stated, and as specifically shown in FIG. 4, the printing process data generally designated 76 are subdivided into three groups including process control data 77, press presetting data 78, and organization data 79.

Figure 5:
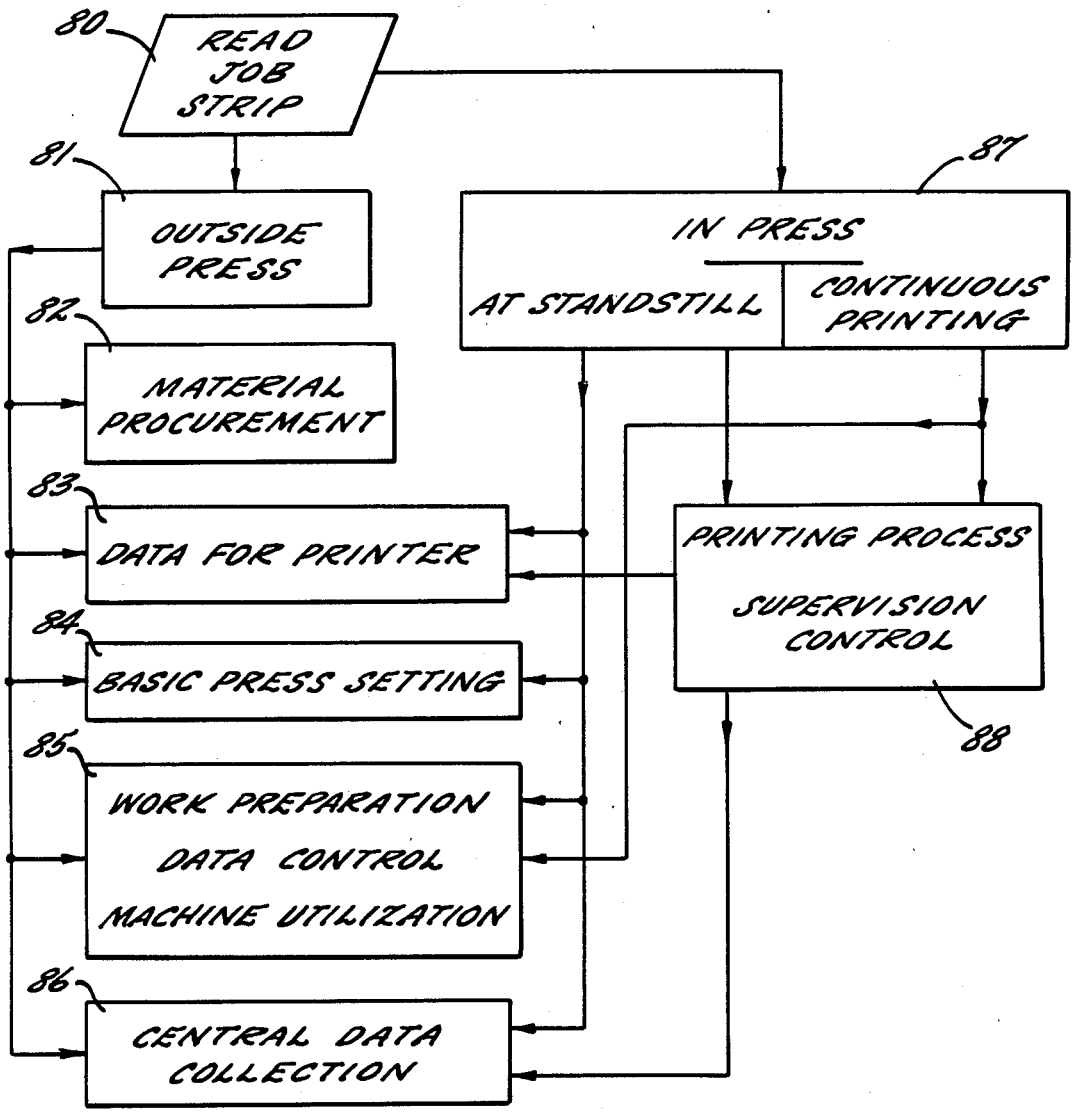
FIG. 5 is a general flow sheet showing the sequence for reading a job strip and using the printing process data encoded therein.

Shown in FIG. 5 is a flow chart showing the sequence of actions taken by the control computer 21 when a job strip is read. As further described below, the sensors 23, 46, 69, and 70 can be active all the time searching for the printing process data on the job strips. When the sensors find this data, in step 80, the control computer 21 knows whether the data were found outside of the printing machine 20 by the stylus scanner 46, or whether the data were found inside the printing machine by the scanners 23, 69, or 70. If the data were found by the stylus scanner 46 outside the press in step 81, then depending on the kind of data found, the data are used for material procurement in step 82, are displayed in step 83 to the machine operator or printer 47 via the display 42, are used in step 84 basic setting-up of the press, are used in step 85 for work preparation, date control, and machine utilization, or are stored in step 86 for centralized data collection.

If the printing process data were read from one of the scanners 23, 69, or 70 inside the printing machine 20, then in step 87 the control computer 21 determines whether the printing machine 20 was engaged in continuous printing. If continuous printing was not occurring, then depending on the printing process data that were read, the data are displayed to the printer 47 in step 83, are used for basic press setting in step 84, are used for work preparation, date control, and machine utilization in step 85, are used for central data collection in step 86, or are used in step 88 for printing process supervision control. If in step 87 the control computer 21 found that continuous printing was occurring, then depending on the data read from the job strips 65 or 66, the data are used in step 88 for printing process supervision control or are used in step 85 for work preparation, date control, or machine utilization.

Figure 6:
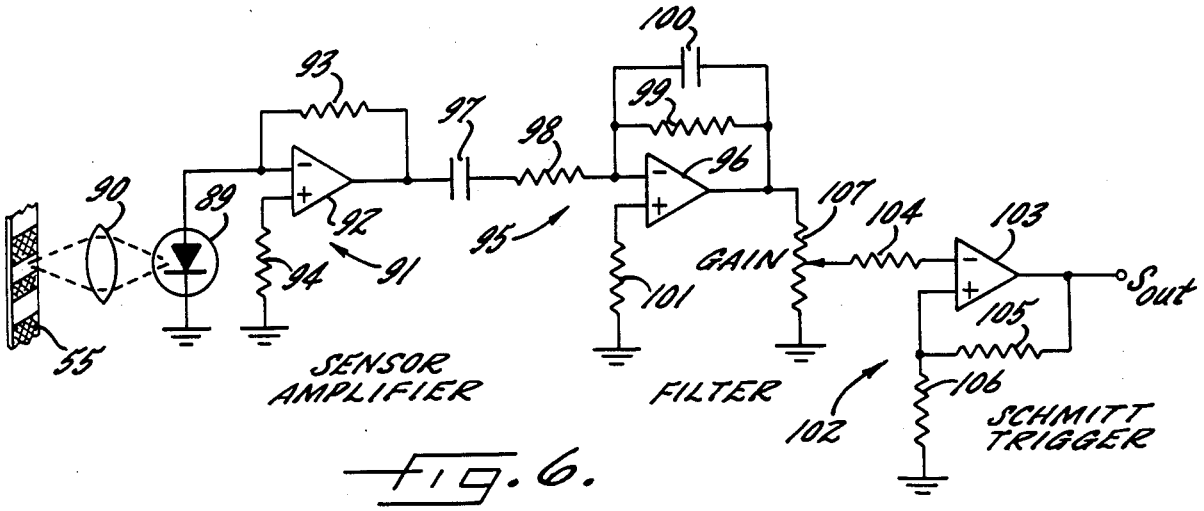
FIG. 6 is a schematic diagram of a sensor amplifier, filter and Schmitt trigger suitable for interfacing a sensor to a computer for reading and decoding the printing process data encoded in a job strip.

Turning now to FIG. 6 there is shown a schematic diagram of a sensor amplifier, filter, and Schmitt trigger for interfacing a photodiode or magnetic read head in the scanners 23, 46, 69, 70 to the control computer 21. As shown in FIG. 6, a photodiode 89 receives an image of the optical job strip 55 (FIG. 2) focused by a lens 90. The sensor amplifier generally designated 91 includes an operational amplifier 92, a gain-setting resistor 93, and a bias resistor 94 for generating an output voltage proportional to the current generated by the photodiode 89. A filter generally designated 95 is used to establish a threshold value or DC level which discriminates between the respective photo-current values corresponding to the light and dark regions on the job strip 55. The filter 95 uses a second operational amplifier 96 and a series bypass capacitor 97, a series input resistor 98, a negative feedback resistor 99, a negative feedback capacitor 100, and a positive input bias resistor 101. The value of the series input capacitor 97 determines the low frequency cutoff of the filter 95 and the value of the negative feedback capacitor 100 determines the high frequency cutoff of the filter. The lower and upper cutoff frequencies correspond to the minimum and maximum scanning rates contemplated for the respective scanners 23, 46, 69, and 70.

To convert the analog output of the filter 95 to a binary or digital signal, the output of the amplifier 86 is fed to the Schmitt trigger generally designated 102. The Schmitt trigger 102 uses a third operational amplifier 103, a negative input resistor 104, a positive feedback resistor 105 and a positive biasing resistor 106. The Schmitt trigger thresholds are symmetrical about the average value of the signal from the filter 95 and the magnitude of the thresholds is determined by a gain-adjusting potentiometer 107.

Although a photodiode 89 is shown in FIG. 6, a conventional magnetic read head can be substituted. A conventional magnetic read head, however, does not have as wide a bandwidth as the photodiode 89 and particularly cannot generate very low frequencies. This is a consequence of the fact that a conventional magnetic read head generates a voltage output proportional to the time rate of change of the magnetic flux received by the magnetic read head. To compensate for the differential response of the read head to magnetic flux, the values of the capacitors 97 and 100 in the filter 95 should be chosen so that the voltage signal from the read head is substantially integrated.

Figure 7:
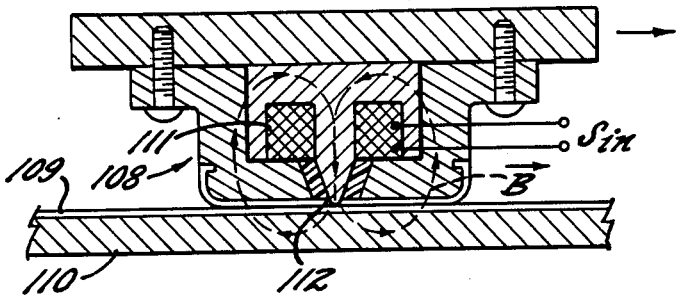
FIG. 7 is a cross sectional view of a recording head suitable for recording printing process data on magnetic strips backed by a magnetically permeable material.
Figure 8:
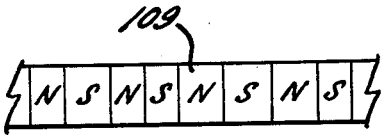
FIG. 8 is a pictorial view of a magnetic job strip showing North and South magnetic poles.

Turning now to FIG. 7 there is shown a cross section of a magnetic recording or read head generally designated 108 for recording or reading a magnetic job strip 109 backed by a magnetically permeable substrate 110. In a conventional tape recorder, the magnetic strip 109 is not backed by a magnetically permeable substrate 110. For use in the present invention, however, the strip 109 could be a conventional strip of magnetic recording material adhesively bonded to a magnetically permeable printing plate, or the magnetic strip 109 could be the printing plate itself backed by an iron or steel plate cylinder. Under these conditions, it may be desirable to use the magnetic recording and read head 108 which substantially magnetizes the magnetic strip 109 in such a way that the magnetic field vector $\vec{B}$ is normal to the surface of the strip. For this purpose, the read head 108 includes an internal electromagnet with a coil 111 and a pole piece 112 where the magnetic field $\vec{B}$ is highly concentrated to cause the strip 109 to become magnetized and saturated. Shown in FIG. 8, for example, is a top view of the strip 109 showing that the data are encoded as respective magnetically saturated regions in the form of strips presenting North (N) or South (S) magnetic poles on the top surface of the strip.

Figure 9:
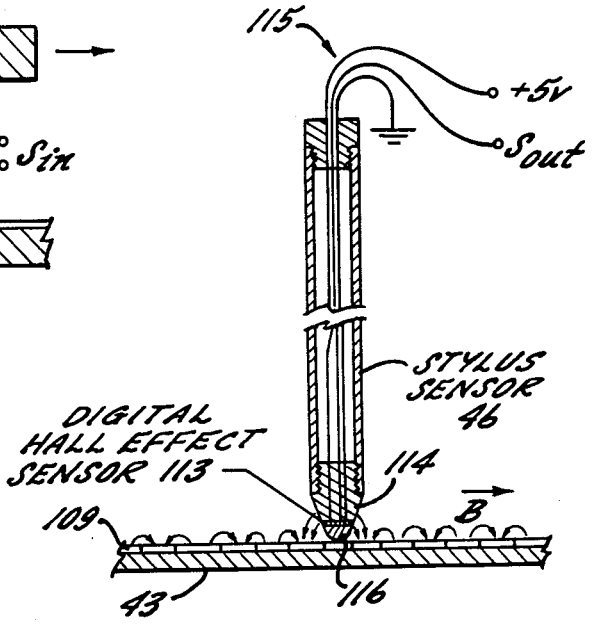
FIG. 9 is a cross sectional view of a stylus sensor using a digital Hall effect sensor for reading the magnetic job strip shown in FIG. 8.

By using the magnetic recording head 108 as shown in FIG. 7, the width of the magnetized strips (N) and (S) can substantially exceed the thickness of the strip 109. As shown in FIG. 9, this property can be useful to allow a digital Hall effect sensor 113 to directly read the North and South magnetic poles on the strip 109. The digital Hall effect sensor 113 is a tiny integrated circuit including a Hall effect element, a sensor amplifier, a Schmitt trigger, and a precision voltage regulator. The Schmitt trigger thresholds are set internally so that the output signal $S_{out}$ is a binary signal indicating whether the digital hall effect sensor 113 is located about a North pole (N) or a South pole (S). Such an integrated circuit is sold in packaged form as a staple item of commerce as part number 8SSl by Micro Switch, a Honeywell Division, 11 West Spring St., Freeport, Ill. 61032. Preferably, the digital Hall effect sensor 113 is mounted on a conical flux concentrator 114 made of a magnetically permeable material which, for example, forms the tip of the stylus sensor 46. The conical flux concentrator 114 has holes to pass three lead wires generally designated 115 from the Hall effect sensor integrated circuit 113 to the control computer 21. The Hall effect sensor integrated circuit 113 uses a standard 5 volt supply voltage. To protect the digital Hall effect sensor 113 from mechanical damage, the tip of the stylus sensor 46 is covered by a thin nose cone 116 of nonmagnetic metal such as brass.

Figure 10:
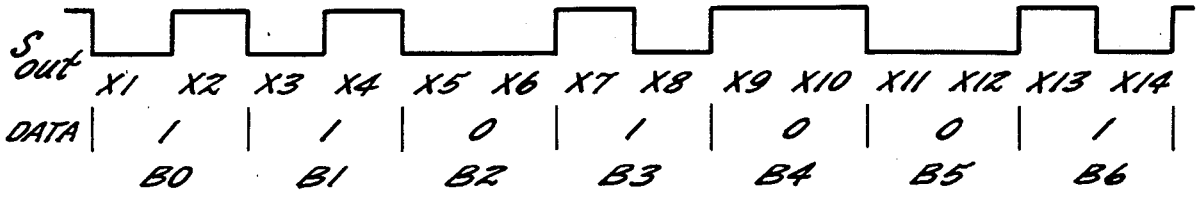
FIG. 10 is a timing diagram showing how data bits are encoded according to one standard kind of self-clocking encoding format.

Using the circuit as shown in FIG. 6 or the digital Hall effect sensor 113 shown in FIG. 9, the output signal $S_{out}$ obtain when the sensor is moved relatively with respect to the job strip has substantially the same character or form as the light and dark regions or the magnetic poles on the job strip. Preferably, the job strip is encoded according to a standard self-clocking binary format such as the Manchester code. FIG. 10 illustrates the properties of this code by showing the association of the data B0–B6 with the output signal $S_{out}$. The output signal can change its binary state between periodic steps or intervals X1–X14. There are two such periodic intervals X1–X14 for each data bit B0–B6. The output signal $S_{out}$ always changes its binary state between the data bits B0–B6. The output signal $S_{out}$, however, may change or not change between the two periodic intervals X1–X14 for each bit depending on whether the value of the respective data bit B0–B6 is a one or a zero, respectively. Due to these conditions, the output signal $S_{out}$ has a DC value exactly between its minimum and maximum values. Therefore, the circuit shown in FIG. 6 can recover the signal $S_{out}$ regardless of the DC value generated by the photodiode 89. In particular, the information content of the signal $S_{out}$ resides between a minimum frequency generated when the binary data is a string of all logical zeros, and up to a maximum frequency of twice the minimum frequency, generated when the binary data is a string of all logical ones.

Figure 11:
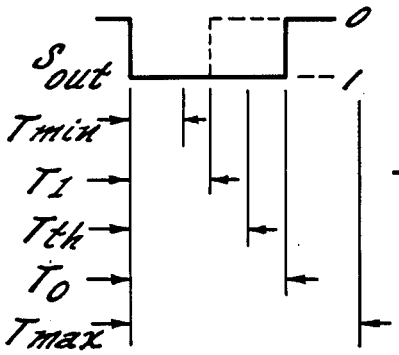
FIG. 11 is a timing diagram used in explaining how a microcomputer can function as a discriminator for decoding data encoded according to the standard self-clocking format of FIG. 10.

As illustrated in FIG. 11, this particular self-clocking binary format permits recovery of the data by a frequency discrimination technique. The time period T between two adjacent transitions in the output signal $S_{out}$, for example, is first measured. This period T is compared to a threshold period $T_{th}$ approximately halfway between the expected periods $T_1$ and $T_0$ obtained for a binary data bit equal to a logical one or a logical zero, respectively. Also, when a logical zero is detected, the transitions represent the boundries between the binary data bits. This detection step presumes that the threshold period $T_{th}$ is known. Regardless of whether the scanning is performed at a known speed, the threshold $T_{th}$ can be determined by inspection of the output signal $S_{out}$ over a time interval including more than one data bit, as will be further described below in conjunction with FIG. 14.

Figure 12:
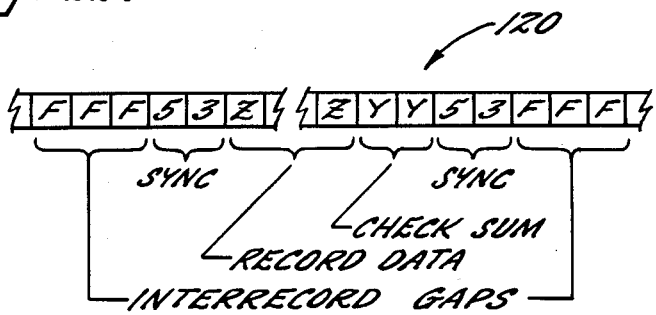
FIG. 12 is a diagram showing how the printing process data is grouped into one or more records when it is recorded on a job strip.

After the individual bits are detected, they are inspected to search for a record of data which is formatted as shown in FIG. 12. The data stream generally designated 120 is shown as a series of hexadecimal digits. The record data is arbitrarily designated as a series of the letters Z which may assume arbitary hexadecimal digits. At the end of the record data, there is included a check sum represented by the two letters Y which have values depending upon the record data. In particular, the check sum is calculated before recording so that the sum of all the record data and the check sum is zero. If, after reading and decoding, the sum of the record data and the check sum is not zero, then an error has occurred and another scanning operation must be performed.

At the beginning and the end of the record data and check sum, there are two predetermined hexadecimal sync digits. For the example shown in FIG. 12, the sync digits are 53 representing the binary sequence 01010011. By using this sync code, the control computer 21 can determine the direction in which the corresponding job strip was scanned. If, for example, the sync code 53 is received, then the record shown in FIG. 12 was scanned from left to right. If, however, the control computer 21 receives the sync code represented by the hexadecimal digits CA or a binary sequence of 11001010, then the record data was scanned backwards, from right to left, resulting in the reversed bit sequence. If the control computer 21 determines that the record data was scanned in reverse, then the bit sequence being read is reversed so that the the direction in which the job strips are scanned is unimportant.

Figure 13:
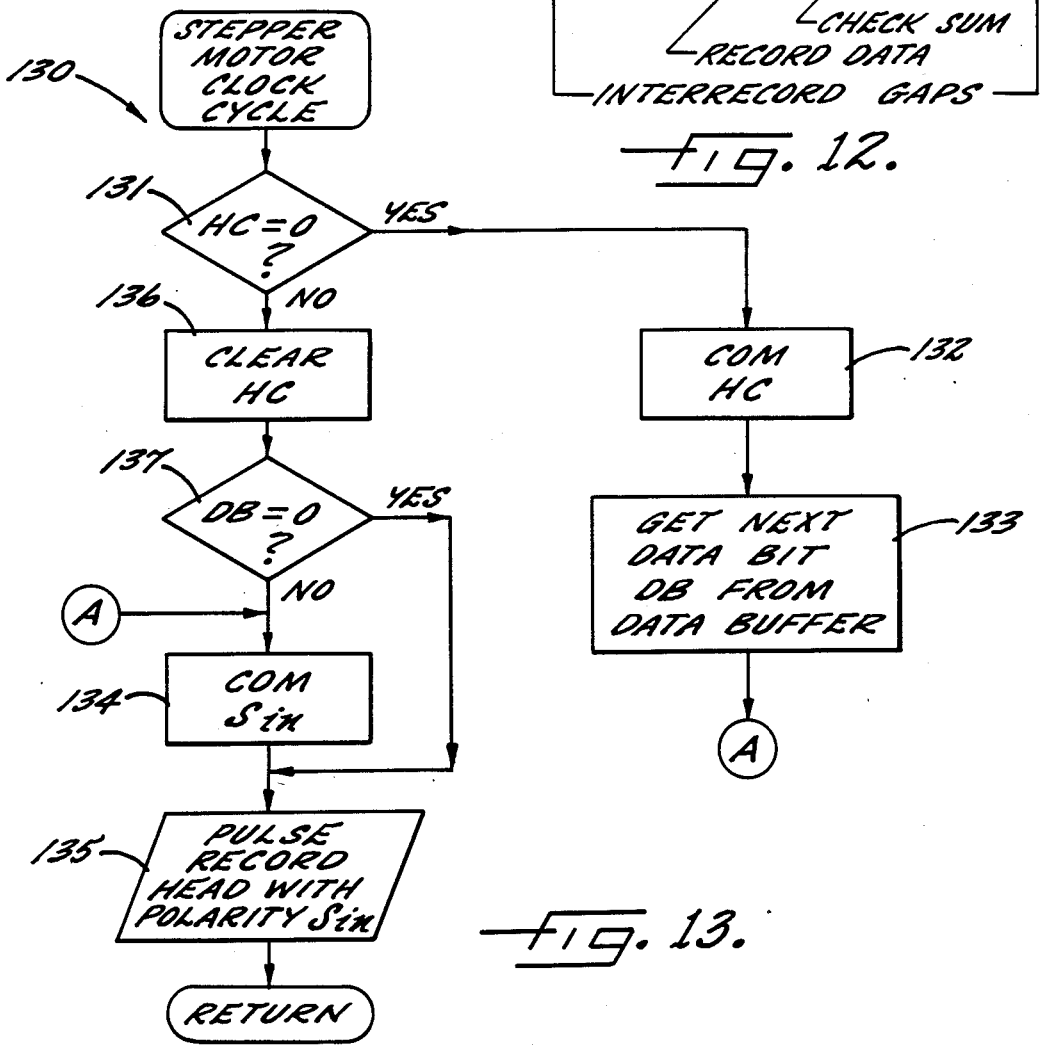
FIG. 13 is a flowchart of a computer interrupt procedure for recording data according to the standard self-clocking format shown in FIG. 10.

Turning now to FIG. 13 there is shown a computer procedure generally designated 130 for generating and recording the self-clocking binary format shown in FIG. 10 from a stream of binary data bits B0–B6 as shown in FIG. 10. The procedure 130 is executed each time the recording device, such as the magnetic head 108 shown in FIG. 7, is stepped to a new position X1–X14. The width of the steps X1–X14, for example, is just slighly smaller than the width of the strip magnetized at any given time by the pole piece 112 of the magnetic recording head 108 in FIG. 7. To distinguish whether a step X1–X14 is the first or second step for a particular bit B0–B6, a flag HC is used. The flag HC is zero for the first step and one for the second step for each data bit B0–B6. The value of the output signal $S_{out}$ is independent of the data value for the first step X1, X3, . . . X13 for each bit B0–B6. Therefore, in step 131 the flag HC is compared to zero to decide whether the signal $S_{in}$ should be determined on the basis of the current data bit DB. If the flag HC is zero, then in step 132 the flag HC is complemented in anticipation of the next step X2, X4 . . . X14, and in step 133 the next data bit DB is obtained from a data buffer formatted according to the record format shown in FIG. 12. The current value of the signal $S_{in}$, however, is not responsive to the current data bit DB for the first step for a data bit. The value $S_{in}$ is the complement of the previous value. Therefore, in step 134, the previous value $S_{in}$ is complemented. Then, in step 135, the record head 108 is pulsed with current, the polarity of the current being responsive to the binary value of the signal $S_{in}$.

If in step 131 the flag HC was not equal to zero, then the record head 108 is at the second step X2, X4 . . . X14 for the respective data bit DB previously obtained in step 133 from the data buffer. In anticipation of the next step X3, X5 . . . X13, the flag HC is cleared in step 136. Then, the logical value of the data bit DB is inspected in step 137 to determine the required value for the signal $S_{in}$. If the logical value of the current data bit DB is equal to zero, then the logical value of the signal $S_{in}$ does not change from its previous value and step 134 is skipped. Otherwise, if the logical value of the data bit DB is equal to one, then in step 134 the signal $S_{in}$ is complemented before being transmitted in step 135 to the recording head 108. If the job strip encodes the printing process data optically, then instead of pulsing a magnetic recording head in step 134, a printer or plotter draws or does not draw a line or dark region, responsive to the binary or logical value of the signal $S_{in}$.

Figure 14:
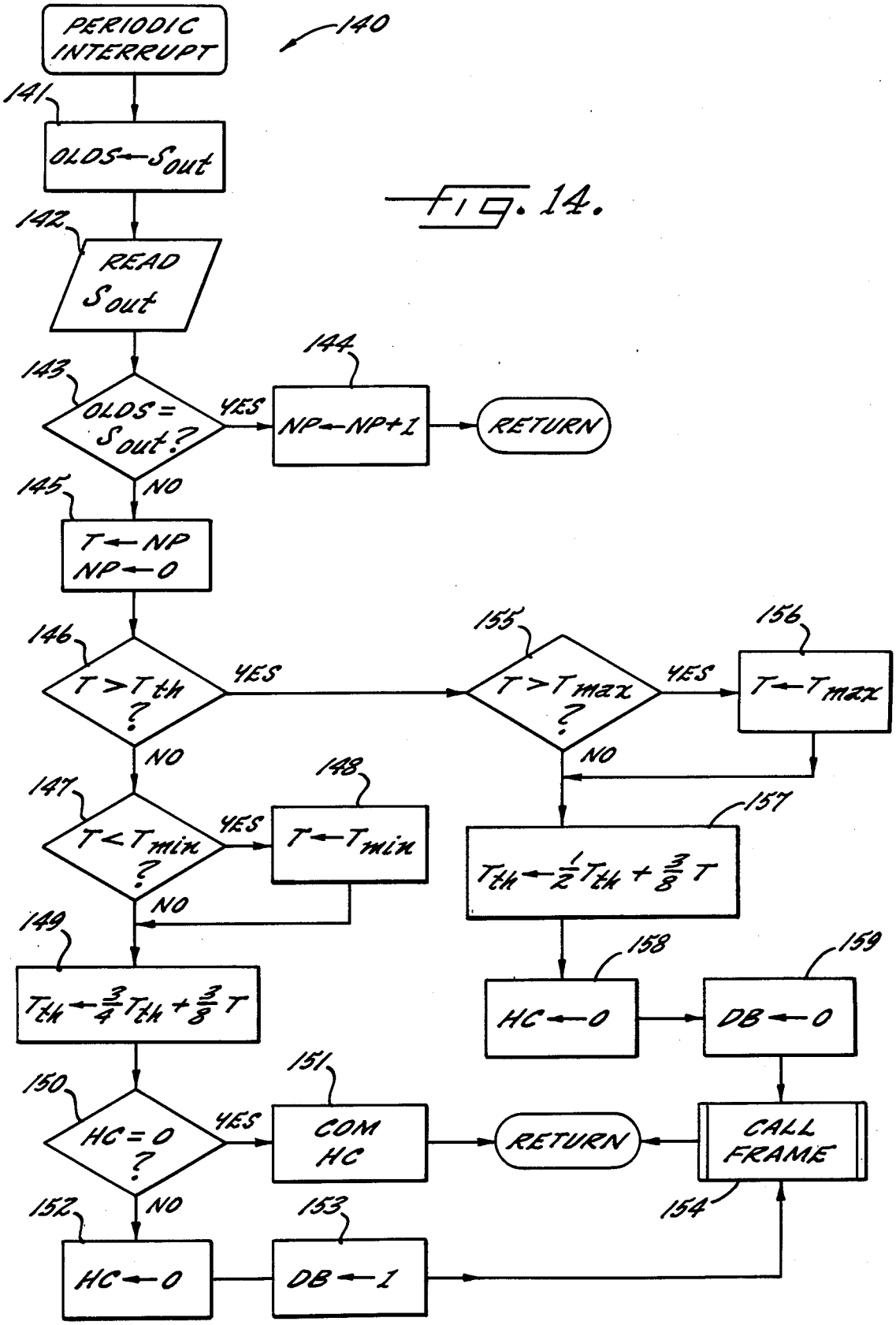
FIG. 14 is a computer interrupt procedure for decoding printing process data from a sensor signal reading a job strip.

Turning now to FIG. 14 there is shown a periodic interrupt routine generally designated 140 for detecting data encoded according to the self-clocking binary format shown in FIG. 10 by employing the procedure described above in connection with FIG. 11. In general terms, the procedure 140 determines the period T between level crossings or edges of the signal $S_{out}$ and compares the period T to the threshold $T_{th}$. Depending upon whether the detected bit is a logical one or a zero, the threshold $T_{th}$ is updated depending upon the measured period T and the logical value of the detected bit. In the first step 141, the current value of the signal $S_{out}$ is saved in a memory location OLDS. In step 142, the present value of the signal $S_{out}$ is obtained. To detect a level crossing or edge in the signal $S_{out}$, in step 143 the previous value OLDS is compared to the new current value $S_{out}$. If they match, then a transition has not occurred and in step 144 a counter NP is incremented to measure the period T between level crossings in the $S_{out}$. These steps are repeated until in step 143 the previous value OLDS is different from the present value $S_{out}$. Then, the period T between the last two level crossings is determined as the number of counts NP, and the number of counts NP is cleared in anticipation of determining the value for the next period T. To discriminate between a binary one and a binary zero encoded in the signal $S_{out}$, in step 146 the period T is compared to the threshold $T_{th}$. If the period T is not greater than the threshold $T_{th}$, then in step 147 the period T is compared to a predetermined minimum period $T_{min}$ representing the minimum period which should ever be measured under proper conditions. $T_{min}$, for example, is half of the threshold $T_{th}$. In step 148, the period T is limited to this minimum value $T_{min}$. In step 149, the threshold value $T_{th}$ is updated by averaging in the measured period T. The formula in step 149 is selected so that for a constant threshold period $T_{th}$, the threshold $T_{th}$ is 150% of the period $T_l$ for a logical one, as shown in FIG. 11. Since a logical one was detected, the half cycle flag HC is tested in step 150 to determine whether the transition detected in step 143 occurred after the first or second step X1–X14 for the respective data bit B0–B6 (see FIG. 10). If the half cycle flag HC is equal to zero, then it is not yet time to register the fact that a binary one is present. Therefore, in step 151 the half cycle flag is complemented and execution returns. Otherwise, if the logical flag HC is not equal to zero in step 150, then in step 152 the half cycle flag HC is set to zero and in step 153 the data bit DB is set to a value of one. This value is transferred in step 154 to a buffer by calling a subroutine FRAME shown in FIG. 15 and described further below.

If in step 146 the period T was greater than the threshold $T_{th}$, then a binary value of zero is detected. In step 155 the period T is compared to a predetermined maximum $T_{max}$ representing the maximum period T that should ever be measured under proper conditions. The value of the maximum $T_{max}$ is, for example, twice the threshold value $T_{th}$. If the maximum value $T_{max}$ is exceeded, then in step 156 the period T is limited to the maximum value. In step 157, the threshold period $T_{th}$ is updated by averaging in the measured value T. The formula in step 157 is selected so that for a constant threshold period $T_{th}$, the period $T_0$ for a binary zero is 125% of the threshold period $T_{th}$, as shown in FIG. 11. In step 158, the half cycle flag is set to zero since a binary zero is always detected in the first step X1, X3 . . . X13 for a respective binary data bit B0–B6. Finally, in step 159, DB is set to zero, and the value is loaded into the data buffer in step 154 by calling the subroutine FRAME.

Figure 15:
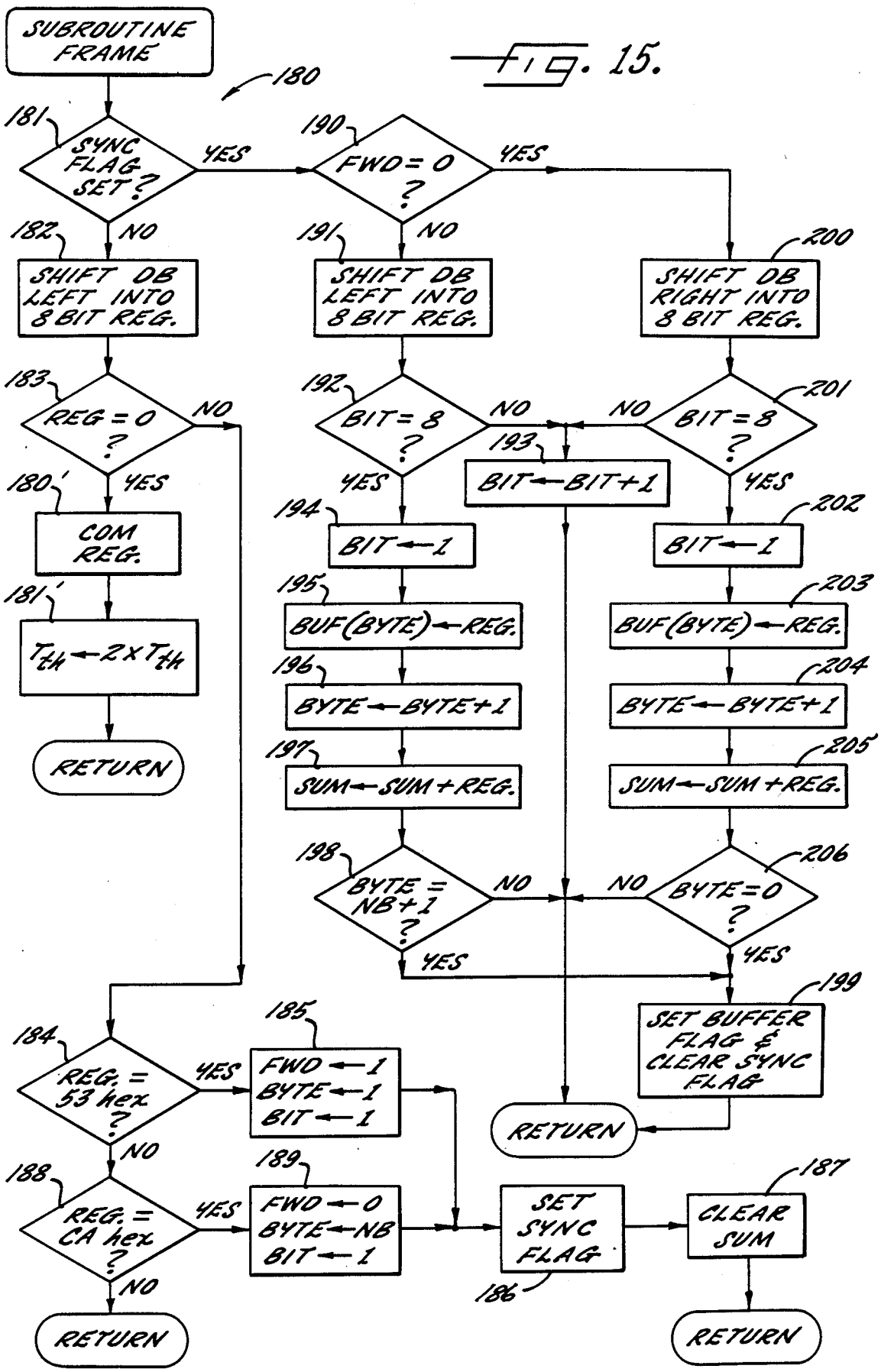
FIG. 15 is a flowchart of a computer subroutine for reading a record of data according to the format shown in FIG. 12. While the invention is susceptible to various modifications and alternative forms, specific embodiments thereof have been shown by way of example in the drawings and will herein be described in detail. It should be understood, however, that the intention is not to limit the invention to the particular forms disclosed, but, on the contrary, the intention is to cover all modifications, equivalents, and alternatives falling within the spirit and scope of the invention as defined by the appended claims.

Turning now to FIG. 15 there is shown a flowchart of the subroutine FRAME called in step 154 of FIG. 14. Referring also to FIG. 12, the subroutine FRAME initially locks onto an interrecord gap and searches for the hexadecimal sync code 53 and also the code CA which is obtained when the record data is scanned in reverse. A sync flag is used to indicate whether one of these sync codes is found, and the sync flag is initially cleared when the control computer 21 is reset. In step 181, the sync flag is tested and if it is not set, then in step 182 the value DB of the data bit is shifted left into an eight-bit shift register. In step 183, the value of the register is compared to zero to determine whether eight successive values of DB were found equal to zero. If so, then in step 180', the contents of the register are complemented or set to one and in step 181' the threshold value $T_{th}$ is doubled. Steps 180' and 181' are performed since the registering of all zeros in the register indicates that an interrecord gap has been detected, but the threshold period $T_{th}$ is half as large as it should be. This false lock condition is a consequence of the fact that the detector 140 in FIG. 14 has a very wide lock range, so that the data encoded in the job strip will be detected regardless of the scanning speed. If in step 183 the contents of the register were not all zeros, then in step 184 the contents of the register are compared to the forward sync code which is presumed to be 53 hexadecimal. If the forward sync code is found, then a forward flag FWD is set to one, a BYTE counter is set to one, and a BIT counter is also set to one in step 185. In step 186, the sync flag is set and in step 187 a check sum register is cleared. If the forward sync code 53 hexadecimal was not found in step 184, then in step 188 the contents of the register are compared to a reverse sync code CA hexadecimal. If the reverse sync code is found, then in step 189 the forward flag FWD is set to zero, the BYTE counter is set to the predetermined number of bytes NB in the record including the one check sum byte, and the BIT counter is set equal to one. Similarly, the sync flag is set in step 186 and the check sum register is cleared in step 187.

If the sync flag was set in step 181, then the value of the data bit DB must be shifted either left or right into the eight-bit shift register depending upon the value of the forward flag FWD. If in step 190 the forward flag was not equal to zero, then in step 191 the value of the data bit DB is shifted left into the eight-bit shift register. Next in step 192 the BIT counter is compared to 8 to determine whether the eight-bit register is full. If not, then in step 193, the BIT counter is incremented and execution returns. Otherwise, in step 194, the BIT counter is reset to one and in step 195 the contents of the eight-bit shift register are transferred to a buffer location pointed to by the BYTE counter. Next, in step 196, the BYTE counter is incremented and in step 197 the check sum is updated by adding in the contents of the 8 bit register. To determine whether the buffer loaded in step 195 is now full, in step 198 the BYTE counter is compared to a limit value of one greater than the number of bytes NB. If this limit value is not exceeded, execution returns. Otherwise, in step 199, a buffer flag is set and the sync flag is cleared to tell the control computer 21 that a job strip has been read. The buffer flag is initially cleared when the control computer 21 is reset or when the control computer 21 finds the buffer flag set. When the control computer finds the buffer flag set, it tests whether the check SUM is equal to zero, and if so the control computer 21 knows that the job strip has been properly read without error.

If in step 190, the forward flag FWD was equal to zero, then the value of the data bit DB must be read in reverse and also the buffer must be loaded in a reverse sequence. Therefore, in step 200 the value DB is shifted right rather than left into the eight-bit shift register. In step 201, the value of the BIT counter is compared to 8, and if it is not equal to 8 the BIT counter is incremented in step 193 and execution returns. Otherwise, in step 202 the bit counter is reset to one and in step 203 the contents of the eight-bit shift register are loaded into the buffer at the location pointed to by the BYTE counter. In step 204, the BYTE counter is decremented rather than incremented due to the fact that the record data is being read in reverse. In step 205, the contents of the register are accumulated in the check SUM and in step 206 the value of the BYTE counter is compared to zero to determine whether the buffer is full. If the value of the BYTE counter is not equal to zero, execution returns to read the rest of the record data. Otherwise, in step 199, the buffer flag is set and the sync flag is cleared as before and execution returns. When the control computer 21 finds the buffer flag set and also finds that the check sum is equal to zero, it knows that a job strip has been properly read and the printing process data are used as shown and described in connection with FIG. 5.

In the manner described above, the printing process data is used for presetting and optimum control of printing during the printing process, and therefore greatly reduces down times for presses in printing shops. There is no risk of different print orders being confused.

What is claimed is:

1. A method of adjusting a rotary offset printing machine of the kind having ink applicator rollers and dampening rollers which apply ink and dampening fluid to a printing plate which has at least one longitudinal edge portion that is clamped on a plate cylinder during printing, said printing plate extending in a circumferential direction around said plate cylinder during printing, said printing plate having an area capable of printing over which the printing plate and blanket cylinder engage and which extends in the circumferential direction and is offset in the circumferential direction from said longitudinal edge portion, said area capable of printing including indicia from which said ink is transferred by a blanket cylinder to a printed sheet carried by an impression cylinder, and said printing machine having adjustment devices controlled by a computer in response to predetermined adjustment data, said method comprising the steps of recording said predetermined adjustment data according to a self-clocking binary format on an elongated strip of material which is attached to an indicia-free zone of the printing plate before the printing plate is clamped on said plate cylinder, said indicia-free zone being accessible by a scanner when the printing plate is clamped to the plate cylinder, and thereafter reading said strip with said scanner and transmitting said recorded predetermined adjustment data to said computer for adjustment of the printing machine for printing when said printing plate is clamed to said plate cylinder, wherein the indicia-free zone is a clean area of the printing plate during printing and the ink applicator rollers and dampening rollers roll over the indicia-free zone to thereby keep the indicia-free zone clean prior to scanning of the recorded adjustment data, said indicia-free zone is displaced in the circumferential direction from said area capable of printing so that said strip of material does not produce a printed image on said sheet, a prefined elongated area parallel and adjacent to said longitudinal edge portion is reproduced on the printing plate in said indicia free zone proximate to said area capable of printing and said strip of material is attached to the printing plate in registration with said elongated area, said adjustment data are read automatically by said scanner when the printing plate is clamped to the plate carrier, said elongated strip is elongated along on axis and said data are read by sacanning along either of the two opposite directions of said axis, and wherein process control data and organization data are also recorded on said strip according to said format along with said adjustment data, said organization data being read by a hand-operated stylus and displayed to a press operator for setting up the press before printing.

2. The method as claimed in claim 1, wherein the data are recorded and read magnetically.

3. A method of adjusting a rotary offset printing machine of the kind having ink applicator rollers and dampening rollers which apply ink and dampening fluid to a printing plate which has at least one longitudinal edge portion that is clamped on a plate cylinder during printing, said printing plate extending in a circumferential direction around said plate cylinder during printing, said printing plate having an area capable of printing over which the printing plate and blanket cylinder engage and which extends in the circumferential direction and is offset in the circumferential direction from said longitudinal edge portion, said printing area including indicia from which said ink is transferred by a blanket cylinder to a printed sheet carried by an impression cylinder, and said printing rachine having adjustment devices controlled by a computer in response to predetermined adjustment data, said method comprising the steps of:

recording data on a strip of material which is elongated along an axis and which is aligned parallel and adjacent to said longitudinal edge portion and attached to an indicia-free zone of the printing plate before the printing plate is claimed to said plate cylinder, the recorded data being recorded according to a self-clocking binary format, the recorded data including said adjustment data and also including organization data for setting up the press before printing, said indicia-free zone being accessible by a scanner when the printing plate is clamped to the plate cylinder, said indicia-free zone being a clean area of the printing plate during printing, said indicia-free zone being rolled over by said ink applicator rollers and said dampening rollers during printing, said indicia-free zone being displaced in the circumferential direction from said area capable of printing so that said strip of material does not produce an image on said sheet during printing;

reading said organization data by scanning said strip along said axis with a hand-operated stylus when said strip is attached to said prinitng plate, and displaying to a press operator said organization data having been read by said stylus, said orgainization data being used by said press operator for setting up said press before printing;

clamping said printing plate to said plate cylinder and then automatically reading said strip with said scanner to retrieve said prerecorded adjustment data; and transmitting the retrieved adjustment data to said computer for adjustment of said printing machine during printing with said printing plate clamped to said plate cylinder.

4. The method as claimed in claim 3, wherein said recorded data is recorded magnetically on said strip.

5. A metod of adjusting a rotary offset printing machine of the kind having ink applicator rollers and dampening rollers which apply ink and dampening fluid to a printing plate which has two longitudinal edge portions which are clamped on a plate cylinder during printing, said printing plate extending in a circumferential direction around said plate cylinder during printing, said printing plate having an area capable of printing over which the printing plate and blanket cylinder engage and which extends in the circumferential direction and is offset in the circumferential direction from said longitudinal edge portions, said area capable of printing including indicia from which said ink is transferred by a blanket cylinder to a printed sheet carried by an impression cylinder, and said printing machine having adjustment devices controlled by a computer in response to predetermined adjustment data, said method comprising the steps of:

recording data on a strip of material which is elongated along an axis and which is aligned parallel and adjacent to one of said longitudinal edge portions and attached to an indicia-free zone of the printing plate before the printing plate is clamped to said plate cylinder, said strip of material being attached to said printing plate in registration with a predefined elongated area reproduced on said printing plate, the recorded data being recorded according to a self-clocking binary format which is readable by scanning said strip along either of the two directions of said axis, the recorded data including said adjustment data and also including press control data and organization data for setting up the press before printing, said indicia-free zone being accessible by a scanner when the printing plate is clamped to the plate cylinder, said indicia-free zone being a clean area of the printing plate during printing, said indicia-free zone being rolled over by said ink applicator rollers and said dampening rollers during printing, said indicia-free zone being displaced in the circumferential direction from said area capable of printing so that said strip of material does not produce an image on said sheet during printing;

reading said organization data by scanning said strip along said axis with a hand-operated stylus when said strip is attached to said printing plate, and displaying to a press operator said organization data having been read by said stylus, said organization data being used by said press operator for setting up said press before printing;

clamping said printing plate to said plate cylinder and then automatically reading said strip with said scanner to retrieve said prerecorded adjustment data; and transmitting the retrieved adjustment data to said computer for adjustment of said printing machine during printing with said printing plate clamped to said plate cylinder.

6. The method as claimed in claim 5, wherein said recorded data is recorded magnetically on said strip.

* * * * *